US008297087B1

(12) United States Patent
Lin

(10) Patent No.: US 8,297,087 B1
(45) Date of Patent: Oct. 30, 2012

(54) IDIOT-PROOF LOCK DEVICE THAT PREVENTS A USER FROM CHANGING THE CODE FREELY AND UNINTENTIONALLY

(75) Inventor: Yu-Shen Lin, Shetou Township, Changhua County (TW)

(73) Assignee: Ging Hwa Long Hardware Industry Co., Ltd., Changhua County (TW)

( * ) Notice: Subject to any disclaimer, the term of this patent is extended or adjusted under 35 U.S.C. 154(b) by 0 days.

(21) Appl. No.: 13/271,286

(22) Filed: Oct. 12, 2011

(51) Int. Cl.
*E05B 37/02* (2006.01)

(52) U.S. Cl. ..... 70/26; 70/30; 70/304; 70/312; 70/317; 70/318

(58) Field of Classification Search ..... 70/22, 26, 70/30, 301, 304–312, 315–318, 323–328, 70/DIG. 21, DIG. 22, DIG. 75, DIG. 76
See application file for complete search history.

(56) References Cited

U.S. PATENT DOCUMENTS 4,615,191 A * 10/1986 Grandy ..... 70/26
5,636,539 A * 6/1997 Tsai ..... 70/315
5,934,120 A * 8/1999 Kuo ..... 70/312
6,209,368 B1 * 4/2001 Lee ..... 70/312
6,386,005 B1 * 5/2002 Kuo ..... 70/28
6,422,051 B1 * 7/2002 Kuo ..... 70/312
6,711,922 B1 * 3/2004 Tsai ..... 70/312
6,799,445 B1 * 10/2004 Tsai ..... 70/30
6,799,446 B1 * 10/2004 Tsai ..... 70/30
6,845,643 B2 * 1/2005 Tsai ..... 70/312
6,860,126 B2 * 3/2005 Ling ..... 70/30
6,880,371 B2 * 4/2005 Huang ..... 70/28
7,337,637 B2 * 3/2008 Kan et al. ..... 70/30
7,412,854 B2 * 8/2008 Raemisch et al. ..... 70/30
2002/0104337 A1 * 8/2002 Kuo ..... 70/30
2002/0134121 A1 * 9/2002 Kuo ..... 70/312
2006/0162400 A1 * 7/2006 Kuo ..... 70/30

* cited by examiner

*Primary Examiner* — Lloyd Gall
(74) *Attorney, Agent, or Firm* — Alan Kamrath; Kamrath IP Lawfirm, PA

(57) ABSTRACT

A lock device includes a locking unit, a connecting unit, and a latch. The locking unit includes a shank, a rotation knob, a control wheel, a plurality of number wheels, a plurality of locating pieces, and a plurality of snap-fit members. The shank has a first positioning hole. The rotation knob has a second positioning hole combined with the first positioning hole of the shank by a positioning member. Thus, the user has to detach the positioning member from the first positioning hole of the shank to release the rotation knob so as to rotate the rotation knob for changing the code of the number wheels, thereby preventing the user from changing the code of the number wheels freely when rotating the rotation knob unintentionally.

8 Claims, 8 Drawing Sheets

IDIOT-PROOF LOCK DEVICE THAT PREVENTS A USER FROM CHANGING THE CODE FREELY AND UNINTENTIONALLY

BACKGROUND OF THE INVENTION

1. Field of the Invention

The present invention relates to a number lock device and, more particularly, to an idiot-proof lock device.

2. Description of the Related Art

A conventional lock device "B" in accordance with the prior art shown in FIGS. 8-11 comprises a locking unit 4, a connecting unit 5, and a latch 6. The locking unit 4 includes a shank 41, a rotation knob 42, a control wheel 43, a plurality of number wheels 44, a plurality of locating pieces 45, a plurality of snap-fit members 46, and a plurality of locking elements 47. The shank 41 has a first end provided with a flange 411. The shank 41 has an interior provided with a through hole 413. The shank 41 has a periphery provided with a slot 412 connected to the through hole 413. The shank 41 has a second end provided with a first locking hole 415. The shank 41 has an outer surface provided with a plurality of bosses 414 which are arranged between the flange 411 and the first locking hole 415. The bosses 414 of the shank 41 are spaced from each other and are arranged in a linear manner. The rotation knob 42 is mounted on the shank 41 and has a first end provided with a receiving chamber 421 and a second end provided with a mounting bore 422 mounted on the flange 411 of the shank 41. The control wheel 43 is received in the receiving chamber 421 of the rotation knob 42. The control wheel 43 has an interior provided with a first mounting hole 431 mounted on the shank 41. The first mounting hole 431 of the control wheel 43 has a surface provided with two first recesses 4312 and a rail 4311. The two first recesses 4312 of the control wheel 43 are perpendicular to each other. Each of the number wheels 44 is mounted on the shank 41, and one of the number wheels 44 abuts the rotation knob 42. Each of the number wheels 44 has an interior provided with a receiving hole 441. The receiving hole 441 of each of the number wheels 44 has a first end provided with a plurality of locking grooves 4411 and a second end provided with a plurality of ribs 4412. The ribs 4412 of each of the number wheels 44 are spaced from each other and are arranged in an annular manner. Each of the locating pieces 45 is received in the receiving hole 441 of a respective one of the number wheels 44. Each of the locating pieces 45 has an end portion provided with an engaging face 452 engaging the ribs 4412 of the respective number wheel 44. Each of the locating pieces 45 has an interior provided with a second mounting hole 451 mounted on the shank 41. The second mounting hole 451 of each of the locating pieces 45 has a surface provided with two second recesses 4511. The two second recesses 4511 of each of the locating pieces 45 are perpendicular to each other. Each of the snap-fit members 46 is received in the receiving hole 441 of a respective one of the number wheels 44 and abuts a respective one of the locating pieces 45. Each of the snap-fit members 46 has an interior provided with a third mounting hole 461 mounted on the shank 41. The third mounting hole 461 of each of the snap-fit members 46 has a surface provided with two third recesses 4612 and a lug 4611. The two third recesses 4612 of each of the snap-fit members 46 are perpendicular to each other. Each of the snap-fit members 46 has a periphery provided with a retaining groove 462. Each of the locking elements 47 is mounted on the retaining groove 462 of a respective one of the snap-fit members 46 and engages the locking grooves 4411 of a respective one of the number wheels 44.

The connecting unit 5 includes a connector 50 connected with the shank 41 of the locking unit 4 by a pin 521 and an elastic member 511 mounted on the shank 41 of the locking unit 4 and biased between one of the snap-fit members 46 of the locking unit 4. The connector 50 of the connecting unit 5 has a side provided with a recessed mounting portion 51 for mounting the elastic member 511 and for connecting the shank 41 of the locking unit 4. The connector 50 of the connecting unit 5 has a periphery provided with a second locking hole 52 which is aligned and concentric with the first locking hole 415 of the shank 41. The pin 521 of the connecting unit 5 is extended through the second locking hole 52 of the connector 50 and is inserted into the first locking hole 415 of the shank 41 to connect the connector 50 of the connecting unit 5 with the shank 41 of the locking unit 4.

The latch 6 has a first end provided with a shaft 62 inserted into the through hole 413 of the shank 41 and a second end provided with an enlarged head 61 protruded outward from the through hole 413 of the shank 41. The shaft 62 of the latch 6 has a periphery provided with a plurality of protrusions 63 slidably mounted in the slot 412 of the shank 41. The protrusions 63 of the latch 6 are spaced from each other and are arranged in a linear manner. The protrusions 63 of the latch 6 are in turn extended through one of the two first recesses 4312 of the control wheel 43, one of the two second recesses 4511 of each of the locating pieces 45 and one of the two third recesses 4612 of each of the snap-fit members 46, and the bosses 414 of the shank 41 are in turn extended through the other one of the two first recesses 4312 of the control wheel 43, the other one of the two second recesses 4511 of each of the locating pieces 45 and the other one of the two third recesses 4612 of each of the snap-fit members 46.

In operation, when the number wheels 44 are rotated to construct the correct code, the latch 6 is unlocked and released from the locking unit 4 so that the latch 6 is disposed at an opened state and can be removed from the shank 41 of the locking unit 4. In adjustment, the rotation knob 42 is rotated through a quarter (¼) circle. Then, the number wheels 44 are rotated to change the code. Then, the rotation knob 42 is rotated through a quarter (¼) circle in the opposite direction. Thus, adjustment of the code is accomplished.

However, the rotation knob 42 can be rotated easily and freely so that the code will be changed when the rotation knob 42 is rotated by the user unintentionally, thereby causing inconvenience to the user. In addition, the user has to initially position each of the locking elements 47 on the retaining groove 462 of the respective snap-fit member 46 and then insert each of the locking elements 47 and the respective snap-fit member 46 into the respective number wheel 44 so that the locking unit 4 is not assembled easily and quickly, thereby greatly wasting the time and energy of assembly.

BRIEF SUMMARY OF THE INVENTION

In accordance with the present invention, there is provided a lock device, comprising a locking unit, a connecting unit connected with the locking unit, and a latch connected with the locking unit. The locking unit includes a shank, a rotation knob, a control wheel, a plurality of number wheels, a plurality of locating pieces, and a plurality of snap-fit members. The shank has an end provided with a flange. The flange of the shank has a periphery provided with a first positioning hole. The rotation knob is mounted on the shank and has a first end provided with a receiving chamber and a second end provided with a mounting bore. The mounting bore of the rotation knob is mounted on the flange of the shank. The rotation knob has a periphery provided with a second positioning hole combined with the first positioning hole of the shank. The control wheel is received in the receiving chamber of the rotation knob. Each of the number wheels is mounted on the shank, and one of the number wheels abuts the rotation knob. Each of the number wheels has an interior provided with a plurality of locking grooves. Each of the snap-fit members is mounted on the shank. Each of the snap-fit members is received in the locking grooves of a respective one of the number wheels. Each of the snap-fit members has an outer wall provided with at least one locking portion engaging the locking grooves of the respective number wheel.

The second positioning hole of the rotation knob is combined with the first positioning hole of the shank by a positioning member which is extended through the second positioning hole of the rotation knob and is inserted into the first positioning hole of the shank to lock the rotation knob onto the flange of the shank so as to prevent the rotation knob from being rotatable relative to the shank. The second positioning hole of the rotation knob is aligned and concentric with the first positioning hole of the shank. Preferably, the first positioning hole of the shank is a screw hole, the second positioning hole of the rotation knob is a screw hole, and the positioning member is a screw. Each of the snap-fit members is integrally formed with the locking portion. Each of the snap-fit members is provided with a plurality of locking portions engaging the locking grooves of the respective number wheel. Preferably, each of the snap-fit members is made of a fiber reinforced plastic (FRP) material.

The primary objective of the present invention is to provide an idiot-proof lock device that prevents a user from changing the code freely and unintentionally.

According to the primary advantage of the present invention, the user has to detach the positioning member from the first positioning hole of the shank to release the rotation knob so as to rotate the rotation knob for changing the code of the number wheels, thereby preventing the user from changing the code of the number wheels easily and freely when rotating the rotation knob unintentionally.

According to another advantage of the present invention, each of the snap-fit members is integrally formed with the locking portion so that each of the snap-fit members is combined with the respective number wheel easily and quickly, thereby saving the time and energy of assembly.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
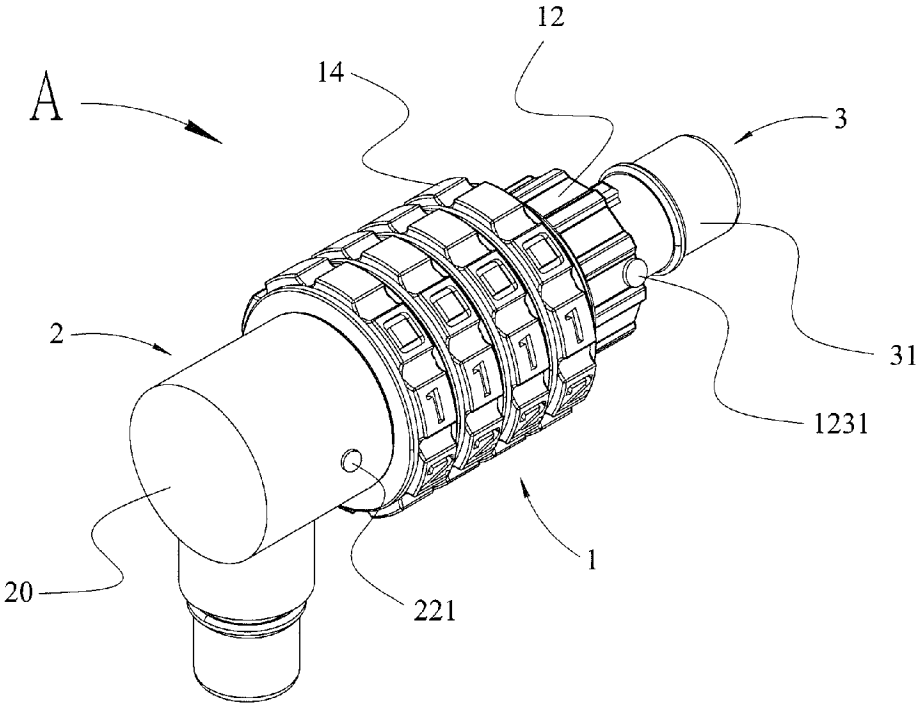
FIG. 1 is a perspective view of a lock device in accordance with the preferred embodiment of the present invention.
Figure 2:
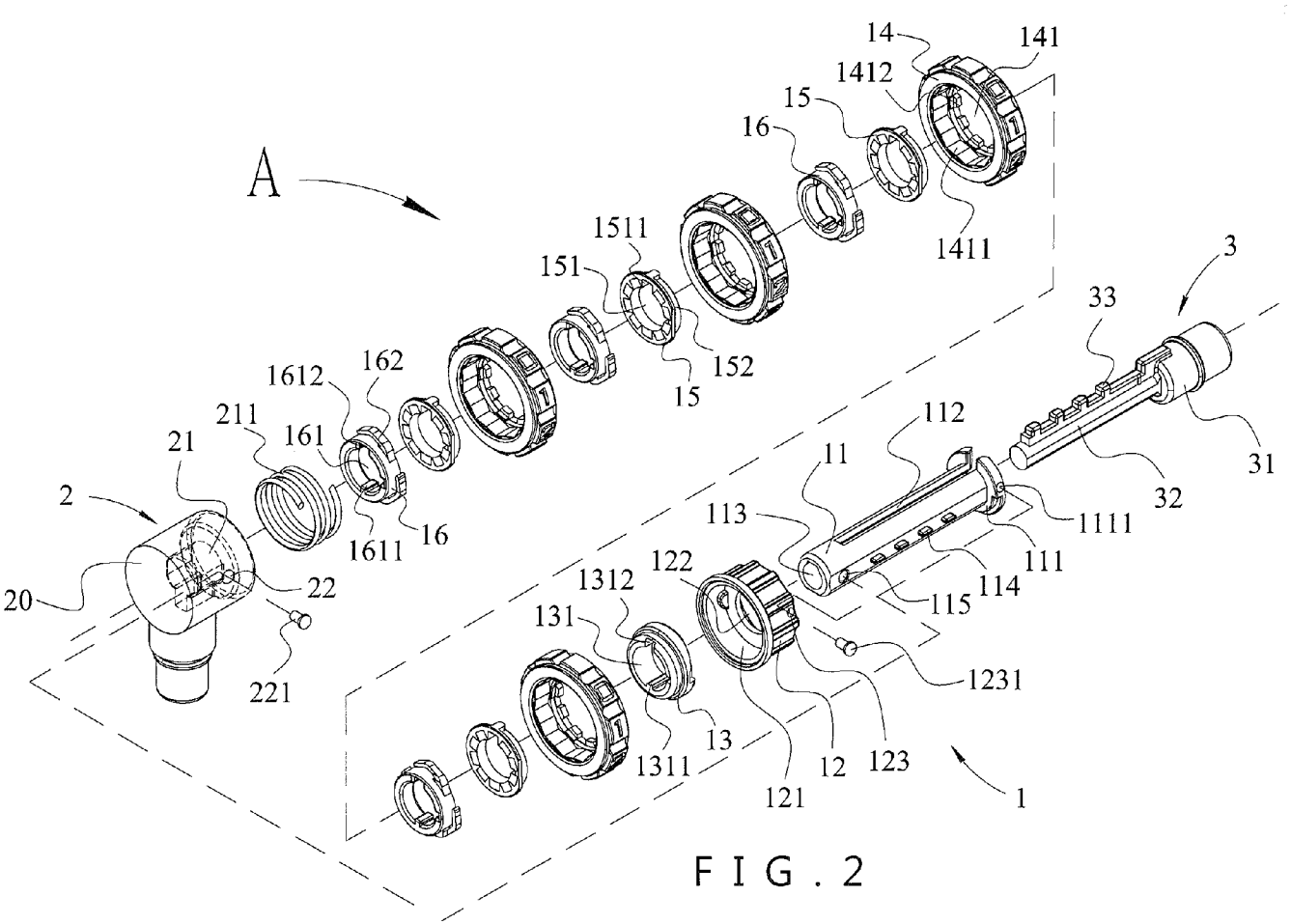
FIG. 2 is an exploded perspective view of the lock device as shown in FIG. 1.
Figure 3:
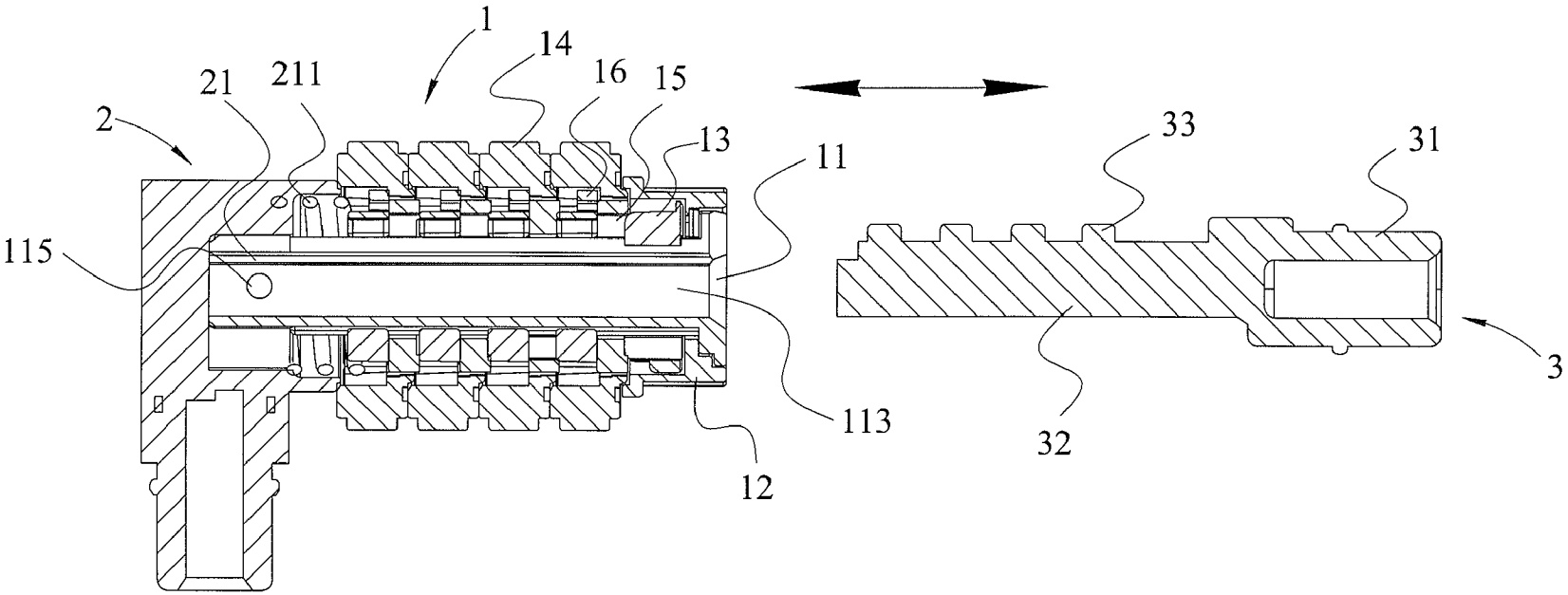
FIG. 3 is a partially front exploded cross-sectional view of the lock device as shown in FIG. 1.
Figure 5:
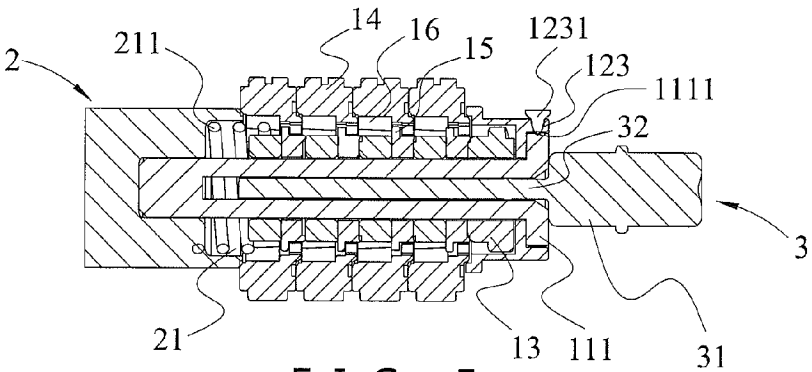
FIG. 5 is a cross-sectional view of the lock device taken along line 5-5 as shown in FIG. 4.
Figure 4:
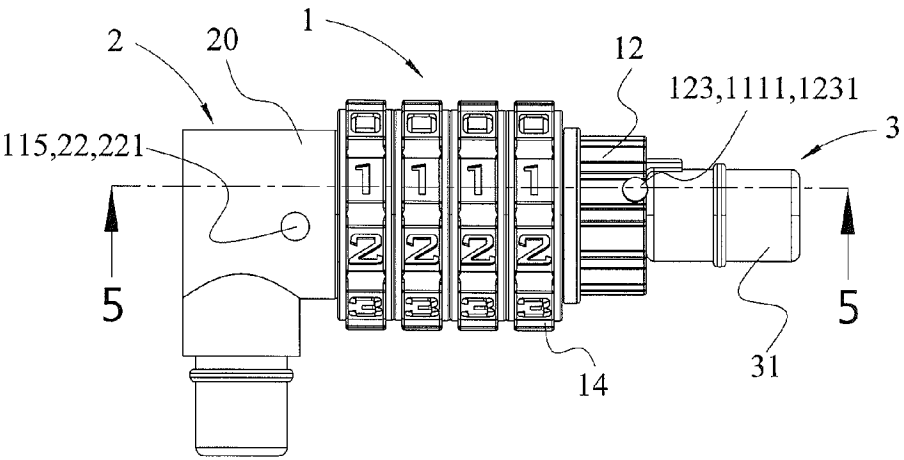
FIG. 4 is a front view of the lock device as shown in FIG. 1.
Figure 7:
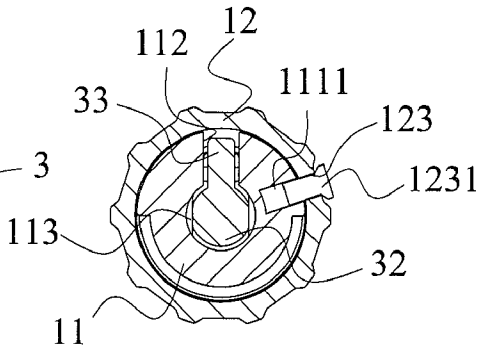
FIG. 7 is a cross-sectional view of the lock device taken along line 7-7 as shown in FIG. 6.
Figure 6:
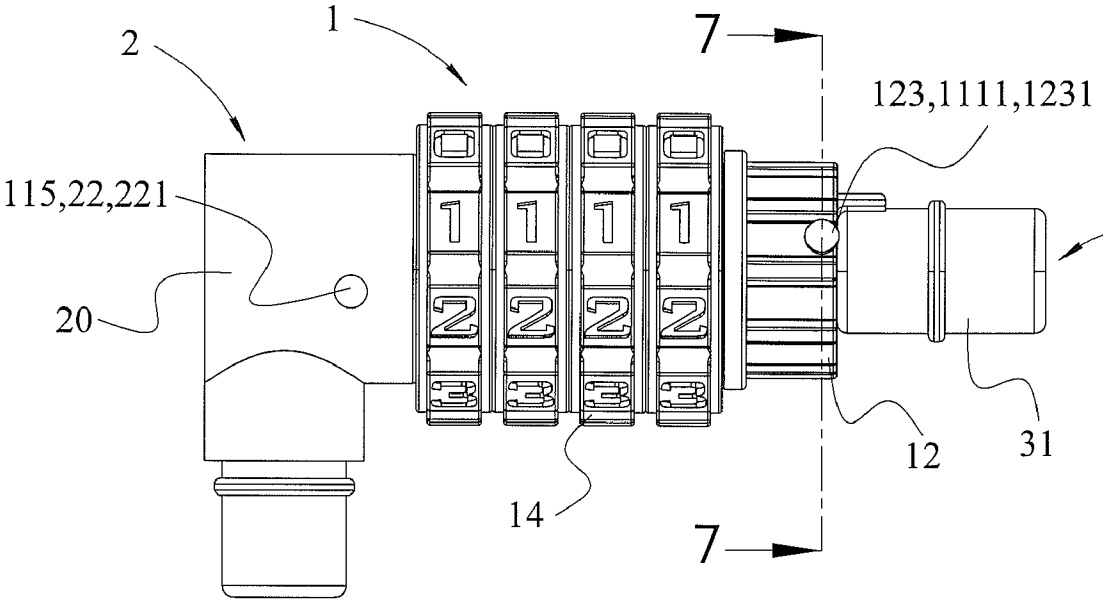
FIG. 6 is a front view of the lock device as shown in FIG. 1.
Figure 8:
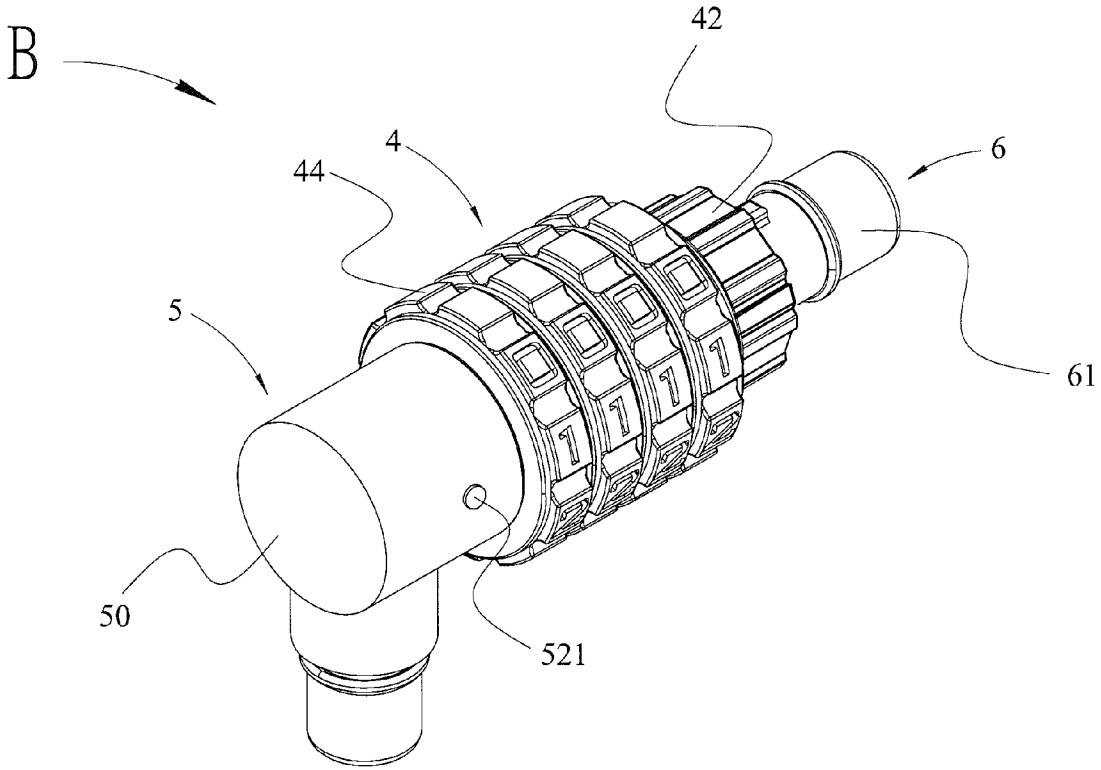
FIG. 8 PRIOR ART
FIG. 8 is a perspective view of a conventional lock device in accordance with the prior art.
Figures 9, 10:
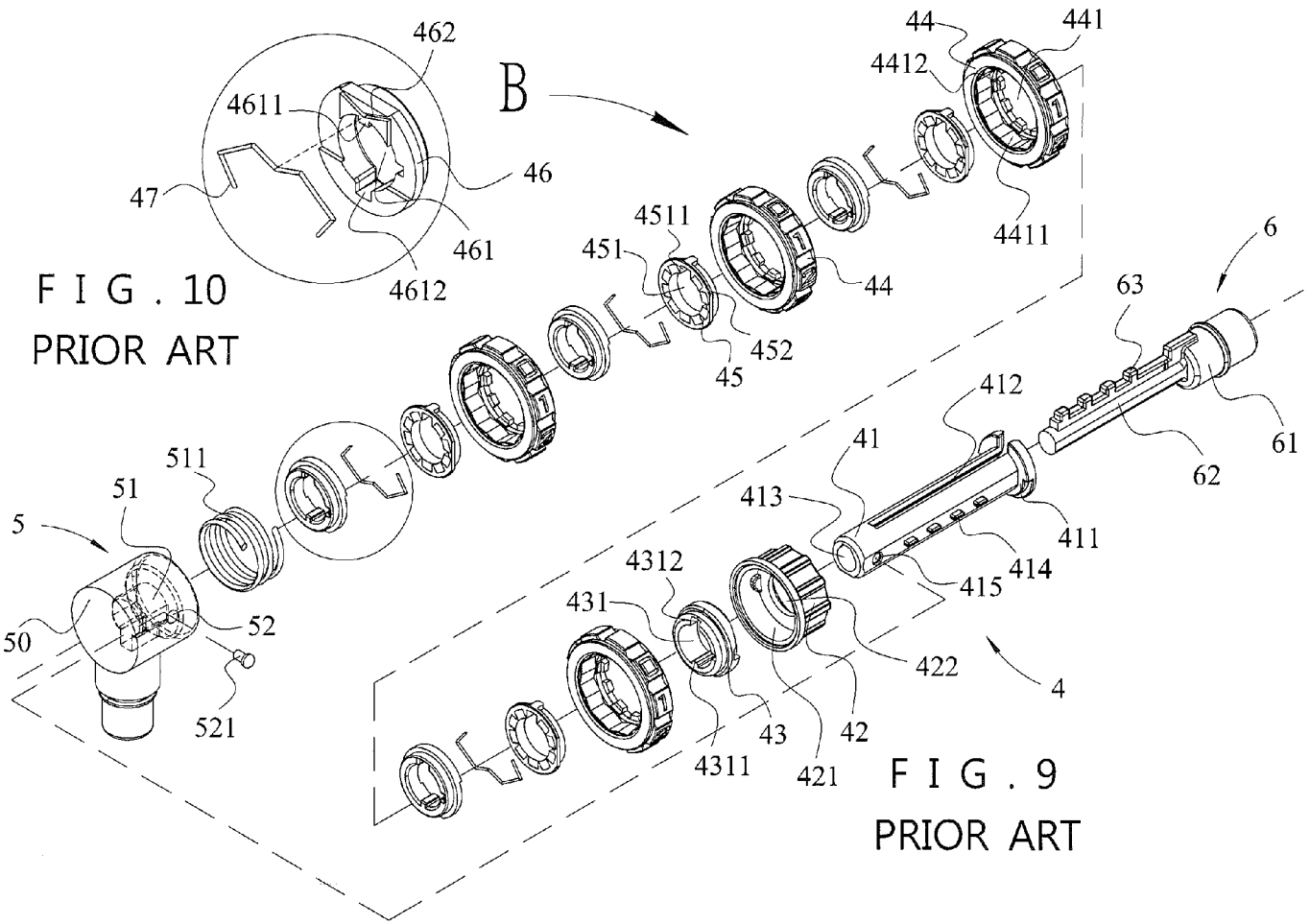
FIG. 9 PRIOR ART
FIG. 10 PRIOR ART
FIG. 9 is an exploded perspective view of the conventional lock device as shown in FIG. 8.
FIG. 10 is a locally enlarged view of the conventional lock device as shown in FIG. 9.
Figure 11:
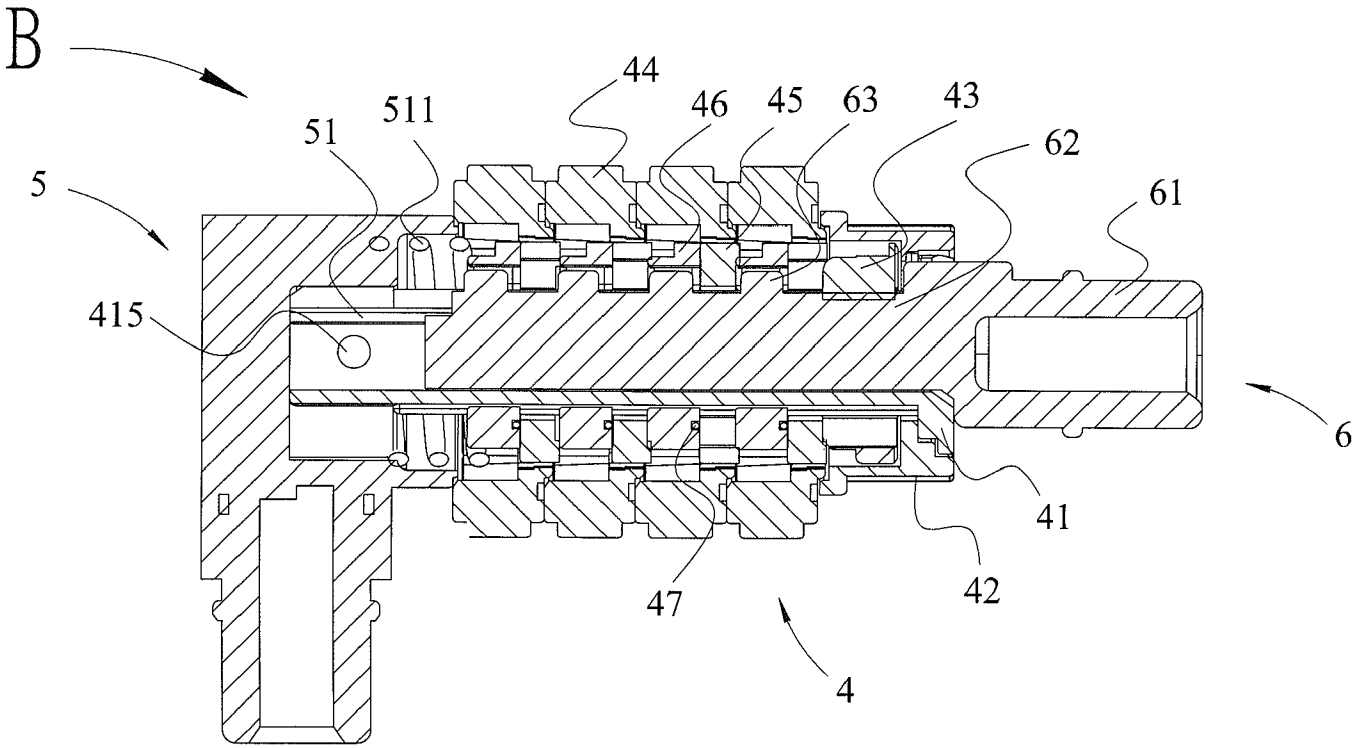
FIG. 11 PRIOR ART
FIG. 11 is a front cross-sectional view of the conventional lock device as shown in FIG. 8.

Referring to FIGS. 1-7, a lock device "A" in accordance with the preferred embodiment of the present invention comprises a locking unit 1, a connecting unit 2 connected with the locking unit 1, and a latch 3 connected with the locking unit 1.

The locking unit 1 includes a shank 11, a rotation knob 12, a control wheel 13, a plurality of number wheels 14, a plurality of locating pieces 15, and a plurality of snap-fit members 16.

The shank 11 has a first end provided with a flange 111. The flange 111 of the shank 11 has a periphery provided with a first positioning hole 1111. Preferably, the first positioning hole 1111 of the shank 11 is a screw hole. The shank 11 has an interior provided with a through hole 113. The shank 11 has a periphery provided with a slot 112 connected to the through hole 113. The shank 11 has a second end provided with a first locking hole 115. The shank 11 has an outer surface provided with a plurality of bosses 114 which are arranged between the flange 111 and the first locking hole 115. The bosses 114 of the shank 11 are spaced from each other and are arranged in a linear manner.

The rotation knob 12 is mounted on the shank 11 and has a first end provided with a receiving chamber 121 and a second end provided with a mounting bore 122 connected to the receiving chamber 121. The mounting bore 122 of the rotation knob 12 is mounted on the flange 111 of the shank 11. The rotation knob 12 has a periphery provided with a second positioning hole 123 combined with the first positioning hole 1111 of the shank 11. The second positioning hole 123 of the rotation knob 12 is aligned and concentric with the first positioning hole 1111 of the shank 11. Preferably, the second positioning hole 123 of the rotation knob 12 is a screw hole. The second positioning hole 123 of the rotation knob 12 is combined with the first positioning hole 1111 of the shank 11 by a positioning member 1231 which is extended through the second positioning hole 123 of the rotation knob 12 and is inserted into the first positioning hole 1111 of the shank 11 to lock the rotation knob 12 onto the flange 111 of the shank 11 so as to prevent the rotation knob 12 from being rotatable relative to the shank 11. Preferably, the positioning member 1231 is a screw.

The control wheel 13 is received in the receiving chamber 121 of the rotation knob 12. The control wheel 13 has an interior provided with a first mounting hole 131 mounted on the shank 11. The first mounting hole 131 of the control wheel 13 has a surface provided with two first recesses 1312 and a rail 1311. The two first recesses 1312 of the control wheel 13 are perpendicular to each other.

Each of the number wheels 14 is mounted on the shank 11, and one of the number wheels 14 abuts the rotation knob 12. Each of the number wheels 14 has an interior provided with a receiving hole 141. The receiving hole 141 of each of the number wheels 14 has a first end provided with a plurality of locking grooves 1411 and a second end provided with a plurality of ribs 1412. The ribs 1412 of each of the number wheels 14 are spaced from each other and are arranged in an annular manner.

Each of the locating pieces 15 is received in the receiving hole 141 of a respective one of the number wheels 14. Each of the locating pieces 15 has an end portion provided with an engaging face 152 engaging the ribs 1412 of the respective number wheel 14. Each of the locating pieces 15 has an interior provided with a second mounting hole 151 mounted on the shank 11. The second mounting hole 151 of each of the locating pieces 15 has a surface provided with two second recesses 1511. The two second recesses 1511 of each of the locating pieces 15 are perpendicular to each other.

Each of the snap-fit members 16 is received in the receiving hole 141 of a respective one of the number wheels 14 and abuts a respective one of the locating pieces 15. Each of the snap-fit members 16 is made of a fiber reinforced plastic (F.R.P.) material. Each of the snap-fit members 16 has an outer wall provided with at least one locking portion 162 engaging the locking grooves 1411 of the respective number wheel 14. Each of the snap-fit members 16 is integrally formed with the locking portion 162 so that each of the snap-fit members 16 is combined with the respective number wheel 14 easily and quickly. Preferably, each of the snap-fit members 16 is provided with a plurality of locking portions 162 engaging the locking grooves 1411 of the respective number wheel 14. Each of the snap-fit members 16 has an interior provided with a third mounting hole 161 mounted on the shank 11. The third mounting hole 161 of each of the snap-fit members 16 has a surface provided with two third recesses 1612 and a lug 1611. The two third recesses 1612 of each of the snap-fit members 16 are perpendicular to each other.

The connecting unit 2 includes a connector 20 connected with the shank 11 of the locking unit 1 by a pin 221 and an elastic member 211 mounted on the shank 11 of the locking unit 1 and biased between one of the snap-fit members 16 of the locking unit 1. The connector 20 of the connecting unit 2 has a side provided with a recessed mounting portion 21 for mounting the elastic member 211 and for connecting the shank 11 of the locking unit 1. The connector 20 of the connecting unit 2 has a periphery provided with a second locking hole 22 which is aligned and concentric with the first locking hole 115 of the shank 11. The pin 221 of the connecting unit 2 is extended through the second locking hole 22 of the connector 20 and is inserted into the first locking hole 115 of the shank 11 to connect the connector 20 of the connecting unit 2 with the shank 11 of the locking unit 1.

The latch 3 has a first end provided with a shaft 32 inserted into the through hole 113 of the shank 11 and a second end provided with an enlarged head 31 protruded outward from the through hole 113 of the shank 11. The shaft 32 of the latch 3 has a periphery provided with a plurality of protrusions 33 slidably mounted in the slot 112 of the shank 11. The protrusions 33 of the latch 3 are spaced from each other and are arranged in a linear manner. The protrusions 33 of the latch 3 are in turn extended through one of the two first recesses 1312 of the control wheel 13, one of the two second recesses 1511 of each of the locating pieces 15 and one of the two third recesses 1612 of each of the snap-fit members 16, and the bosses 114 of the shank 11 are in turn extended through the other one of the two first recesses 1312 of the control wheel 13, the other one of the two second recesses 1511 of each of the locating pieces 15 and the other one of the two third recesses 1612 of each of the snap-fit members 16.

In operation, when the number wheels 14 are rotated to construct the correct code, the latch 3 is unlocked and released from the locking unit 1 so that the latch 3 is disposed at an opened state and can be removed from the shank 11 of the locking unit 1.

In adjustment, after the positioning member 1231 is detached from the first positioning hole 1111 of the shank 11, the rotation knob 12 is unlocked from the positioning member 1231 so that the rotation knob 12 can be rotated. In such a manner, the rotation knob 12 is rotated through a quarter (¼) circle. Then, the number wheels 14 are rotated to change the code. Then, the rotation knob 12 is rotated through a quarter (¼) circle in the opposite direction. Thus, adjustment of the code is accomplished. After the adjustment of the code is accomplished, the positioning member 1231 is again inserted into the first positioning hole 1111 of the shank 11 to lock the rotation knob 12 onto the flange 111 of the shank 11 so that the rotation knob 12 is locked and cannot be rotated any more.

Accordingly, the user has to detach the positioning member 1231 from the first positioning hole 1111 of the shank 11 to release the rotation knob 12 so as to rotate the rotation knob 12 for changing the code of the number wheels 14, thereby preventing the user from changing the code of the number wheels 14 easily and freely when rotating the rotation knob 12 unintentionally. In addition, each of the snap-fit members 16 is integrally formed with the locking portion 162 so that each of the snap-fit members 16 is combined with the respective number wheel 14 easily and quickly, thereby saving the time and energy of assembly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A lock device, comprising:

a locking unit, a connecting unit connected with the locking unit, and a latch connected with the locking unit;

wherein the locking unit includes a shank, a rotation knob, a control wheel, a plurality of number wheels, a plurality of locating pieces, and a plurality of snap-fit members;

the shank has an end provided with a flange;

the flange of the shank has a periphery provided with a first positioning hole;

the rotation knob is mounted on the shank and has a first end provided with a receiving chamber and a second end provided with a mounting bore;

the mounting bore of the rotation knob is mounted on the flange of the shank;

the rotation knob has a periphery provided with a second positioning hole combined with the first positioning hole of the shank;

the control wheel is received in the receiving chamber of the rotation knob;

each of the number wheels is mounted on the shank;

one of the number wheels abuts the rotation knob;

each of the number wheels has an interior provided with a plurality of locking grooves;

each of the snap-fit members is mounted on the shank;

each of the snap-fit members is received in the locking grooves of a respective one of the number wheels;

each of the snap-fit members has an outer wall provided with at least one locking portion engaging the locking grooves of the respective number wheel.

2. The lock device of claim 1, wherein the second positioning hole of the rotation knob is combined with the first positioning hole of the shank by a positioning member which is extended through the second positioning hole of the rotation knob and is inserted into the first positioning hole of the shank to lock the rotation knob onto the flange of the shank so as to prevent the rotation knob from being rotatable relative to the shank.

3. The lock device of claim 2, wherein the second positioning hole of the rotation knob is aligned and concentric with the first positioning hole of the shank.

4. The lock device of claim 1, wherein the first positioning hole of the shank is a screw hole.

5. The lock device of claim 4, wherein the second positioning hole of the rotation knob is a screw hole.

6. The lock device of claim 2, wherein the positioning member is a screw.

7. The lock device of claim 1, wherein each of the snap-fit members is integrally formed with a plurality of locking portions engaging the locking grooves of the respective number wheel.

8. The lock device of claim 1, wherein each of the snap-fit members is made of a fiber reinforced plastic (FRP) material.

* * * * *